US007530198B2

(12) United States Patent
Matsuyama et al.

(10) Patent No.: US 7,530,198 B2
(45) Date of Patent: May 12, 2009

(54) SWING DOOR OPENING/CLOSING DETECTION SYSTEM

(75) Inventors: Toshiyasu Matsuyama, Shiga (JP); Yasuhiro Takada, Shiga (JP)

(73) Assignee: Optex Co., Ltd., Otsu-shi (JP)

( * ) Notice: Subject to any disclaimer, the term of this patent is extended or adjusted under 35 U.S.C. 154(b) by 477 days.

(21) Appl. No.: 11/254,768

(22) Filed: Oct. 21, 2005

(65) Prior Publication Data

US 2006/0087272 A1 Apr. 27, 2006

(30) Foreign Application Priority Data

Oct. 22, 2004 (JP) ..... 2004-308918

(51) Int. Cl.
*E05F 15/02* (2006.01)

(52) U.S. Cl. ..... 49/27; 49/324; 49/327

(58) Field of Classification Search ..... 49/26, 49/27; 296/56

See application file for complete search history.

(56) References Cited

U.S. PATENT DOCUMENTS 4,577,437 A * 3/1986 Gionet et al. ..... 49/25
5,963,000 A * 10/1999 Tsutsumi et al. ..... 318/480
2004/0107640 A1* 6/2004 Ishihara et al. ..... 49/27

* cited by examiner

*Primary Examiner*—Katherine W Mitchell
*Assistant Examiner*—Michael J Keller
(74) *Attorney, Agent, or Firm*—Oblon, Spivak, McClelland, Maier & Neustadt, P.C.

(57) ABSTRACT

The present invention provides a swing door opening/closing detection system capable of accurately discriminating an opening/closing position of door main bodies to accordingly prevent the malfunction of the door main bodies. The swing door opening/closing detection system includes: door main bodies 12, 14 which are rotatably provided and which rotate to open/close relative to an opening part 11; driving parts 20, 22 rotary driving the door main bodies 12, 14; a control part 24 controlling the rotary driving of the door main bodies 12, 14 by the driving parts 20, 22; a sensing part 30 (28) attached to the door main bodies 12, 14 to sense a person or an object in sensing areas on paths of the door main bodies 12, 14; a deformation part 42 deforming according to the rotational operation of the door main bodies 12, 14; and a discriminating part 40 (28) which discriminates the opening/closing position of the door main bodies 12, 14 based on a deformation amount of the deformation part 42 to control the control part 24 based on the discrimination result.

8 Claims, 7 Drawing Sheets

SWING DOOR OPENING/CLOSING DETECTION SYSTEM

BACKGROUND OF THE INVENTION

1. Field of the Invention

The present invention relates to a swing door opening/closing detection system capable of detecting the opening/closing position of a swing door.

2. Description of the Related Art

Conventionally, a so-called double-leaf automatic swing door system has been known. As shown in FIG. 7, a double-leaf automatic swing door system 100 includes: a pair of door main bodies 102, 104 disposed in an opening part 101; motors 110, 112 rotating the respective door main bodies 102, 104 on rotary shafts 106, 108 attached to the respective door main bodies 102, 104; and a control part 114 controlling the motors 110, 112. The door main bodies 102, 104 in a closed position are positioned so that one-side widthwise end portions thereof face each other. Driving one or both of the door main bodies 102, 104 in this position by the motor(s) 110, 112 causes one or both of the door main bodies 102, 104 to rotate on the rotary shaft(s) 106, 108, thereby bringing one or both of the door main bodies 102, 104 into an opened position.

Here, from a viewpoint of ensuring safety, object sensors 120, 122 are attached on approach-side surfaces and swinging-side surfaces of the door main bodies 102, 104. With this structure, the rotary driving of the door main bodies 102, 104 is stopped when the object sensors 120, 122 sense a person on a path of the door main body 102 or 104 while the door main bodies 102, 104 are rotary driven so as to close or open relative to the opening part 101, whereby the contact of the door main bodies 102, 104 with a person can be prevented.

Since the aforesaid object sensors are attached to the door main bodies, sensing areas thereof change when the door main bodies are rotary driven, and an object such as a guide rail, a wall, or the like, if any in the sensing areas, is also sensed by the object sensors. Therefore, controlling the rotary driving of the door main bodies based on information from the object sensors involves a possibility of causing a malfunction of the door main bodies.

Further, in the structure of attaching the object sensors to the rotary-driven door main bodies, electrical wirings for power supply and signal transmission/receipt have to be connected to the object sensors. In this case, wiring covers for protecting the electrical wirings need to be attached to the door main bodies.

SUMMARY OF THE INVENTION

Therefore, considering the above-described circumstances, it is an object of the present invention to provide a swing door opening/closing detection system that is capable of preventing a malfunction of door main bodies by accurately discriminating an opening/closing position of the door main bodies and controlling the rotary driving of the door main bodies based on the discrimination result.

An exemplary embodiment of the invention includes: a door main body which is rotatably provided and which rotates to open/close relative to an opening part; a driving part rotary driving the door main body; a control part controlling the rotary driving of the door main body by the driving part; a sensing part attached to the door main body to sense a person or an object in a sensing area on a path of the door main body; a deformation part deforming according to a rotational operation of the door main body; and a discriminating part which discriminates an opening/closing position of the door main body based on a deformation amount of the deformation part to control the control part based on a result of the discrimination.

According to another aspect of the invention, the control part controls the driving part to control the rotary driving of the door main body. The door main body is controlled by the driving part to open/close relative to the opening part. Note that the sensing part is attached to the door main body, and a person or an object, if any in the sensing area on the path of the door main body, is sensed by the sensing part.

Here, when the door main body is rotary driven, the deformation part deforms according to the rotational operation of the door main body. Then, the discriminating part discriminates the opening/closing position of the door main body based on the deformation amount of the deformation part, to thereby control the control part based on the discrimination result. This configuration enables accurate discrimination (recognition) of the opening/closing position of the door main body, and the control part can accurately control the driving part and the door main body based on the discrimination result. Therefore, the malfunction of the door main body can be prevented.

Note that "the opening/closing position" in this specification includes an opened/closed position (rotation angle) of the door main body, a rotation speed, and a rotation direction (a direction for opening or closing relative to the opening part).

According to another exemplary embodiment, in the swing door opening/closing detection system discussed above, the deformation part is a wiring cover protecting an electrical wiring connected to the sensing part.

In an embodiment, since the deformation part is the wiring cover protecting the electrical wiring connected to the sensing part, the wiring cover indispensable for the electrical wiring can be used for discriminating the opening/closing position of the door main body. This can reduce not only the number of parts but also manufacturing cost, compared with a case where a separate member is used for discriminating the opening/closing position of the door main body.

According to a further aspect of the invention, in the swing door opening/closing detection system discussed above, one end of the wiring cover is attached to the door main body to be rotatable about an axis and the other end of the wiring cover is fixed to a fixed wall, and the discriminating part discriminates the opening/closing position of the door main body based on a torsional deformation amount of the wiring cover that torsionally deforms in accordance with the rotational operation of the door main body.

According to another aspect of the invention, since one end of the wiring cover is attached to the door main body to be rotatable about the axis and the other end of the wiring cover is fixed to the fixed wall, the wiring cover torsionally deforms according to the rotational operation of the door main body when the door main body is rotary driven. Then, the discriminating part discriminates the opening/closing position of the door main body based on the torsional deformation amount of the wiring cover to control the control part based on the discrimination result. This enables accurate discrimination (recognition) of the opening/closing position of the door main body, and the control part can accurately control the driving part and the door main body based on the discrimination result. Therefore, the malfunction of the door main body can be prevented.

According to a further aspect of the invention, in the swing door opening/closing detection system discussed above, the deformation part is one of an electrical wiring connected to the sensing part and a bending deformation member included in the electrical wiring, and the discriminating part discriminates the opening/closing position of the door main body based on a bending deformation amount of one of the electrical wiring and the bending deformation member that bendingly deform in accordance with the rotational operation of the door main body.

According to a further aspect of the invention, the deformation part is one of the electrical wiring connected to the sensing part and the bending deformation member included in the electrical wiring, and the discriminating part discriminates the opening/closing position of the door main body based on the bending deformation amount of one of the electrical wiring and the bending deformation member that bendingly deform in accordance with the rotational operation of the door main body, and controls the control part based on the discrimination result. This enables accurate discrimination (recognition) of the opening/closing position of the door main body, and the control part can accurately control the driving part and the door main body based on the discrimination result. Therefore, the malfunction of the door main body can be prevented.

According to a further aspect of the invention, in the swing door opening/closing detection system discussed above, the sensing part also functions as the discriminating part.

According to an aspect of the invention where the sensing part also functions as the discriminating part, it is possible to reduce the number of parts and the trouble accompanying the installation. Further, less installation space is required compared with a case where a separate member serves as the sensing part and the both units are provided in a space near the swing door, so that space saving is achieved.

DETAILED DESCRIPTION OF THE PREFERRED EMBODIMENT

Next, a swing door opening/closing detection system according to one embodiment of the present invention will be described with reference to the drawings.

Figure 1:
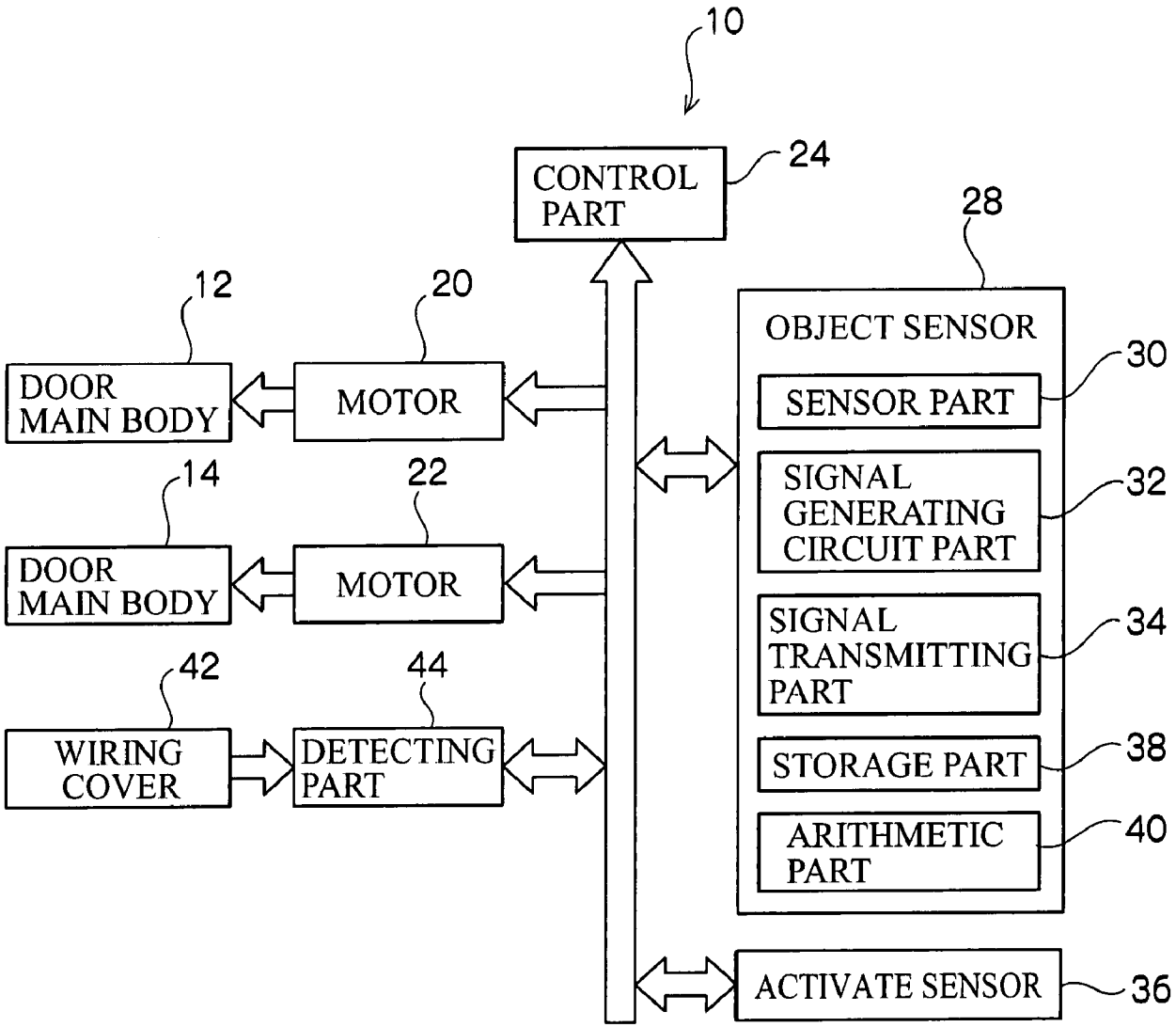
FIG. 1 is a block diagram showing a configuration of a swing door opening/closing detection system according to an embodiment.
Figure 2:
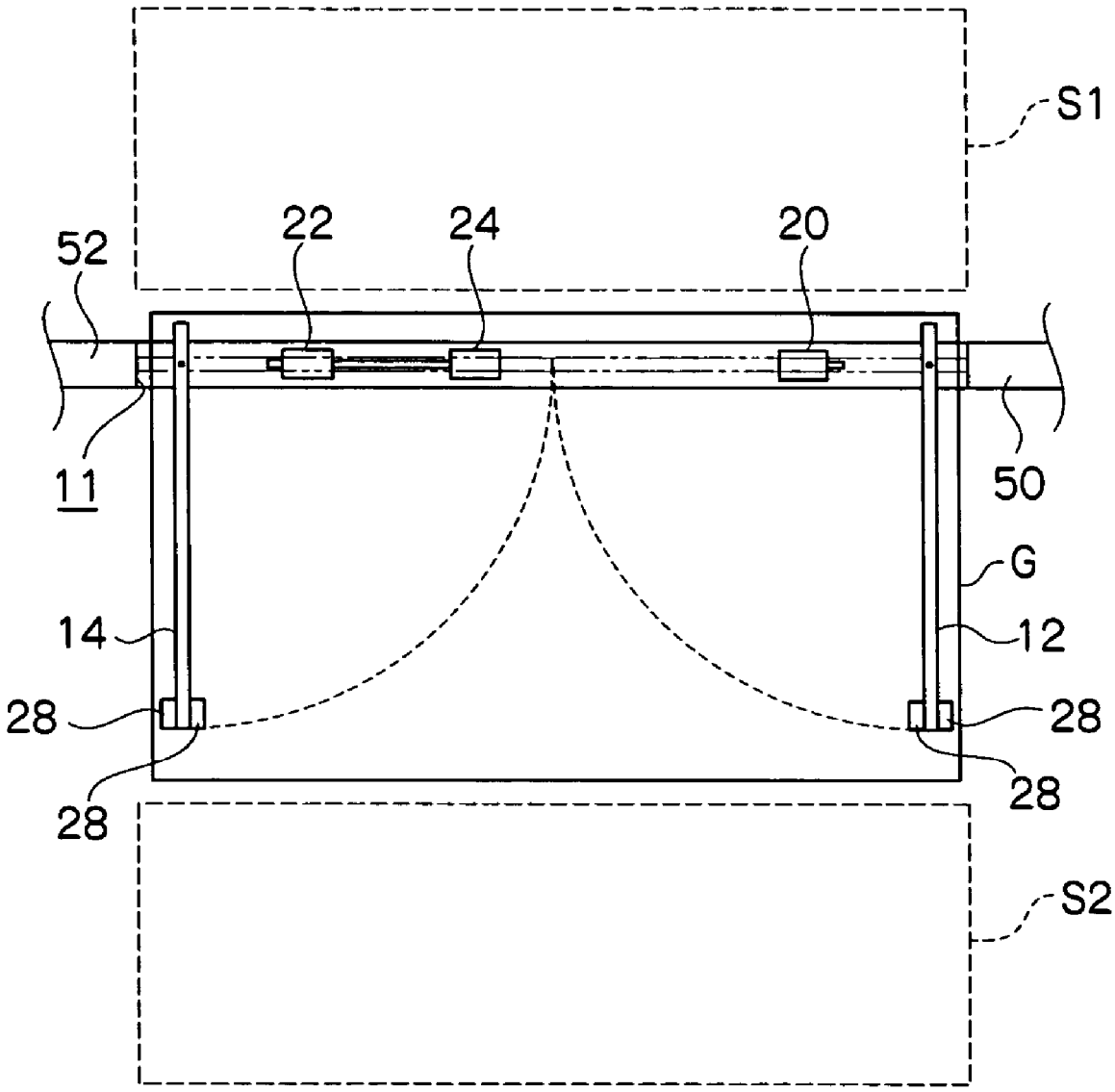
FIG. 2 is a plane view showing an opened position in which door main bodies are open relative to an opening part.
Figure 3:
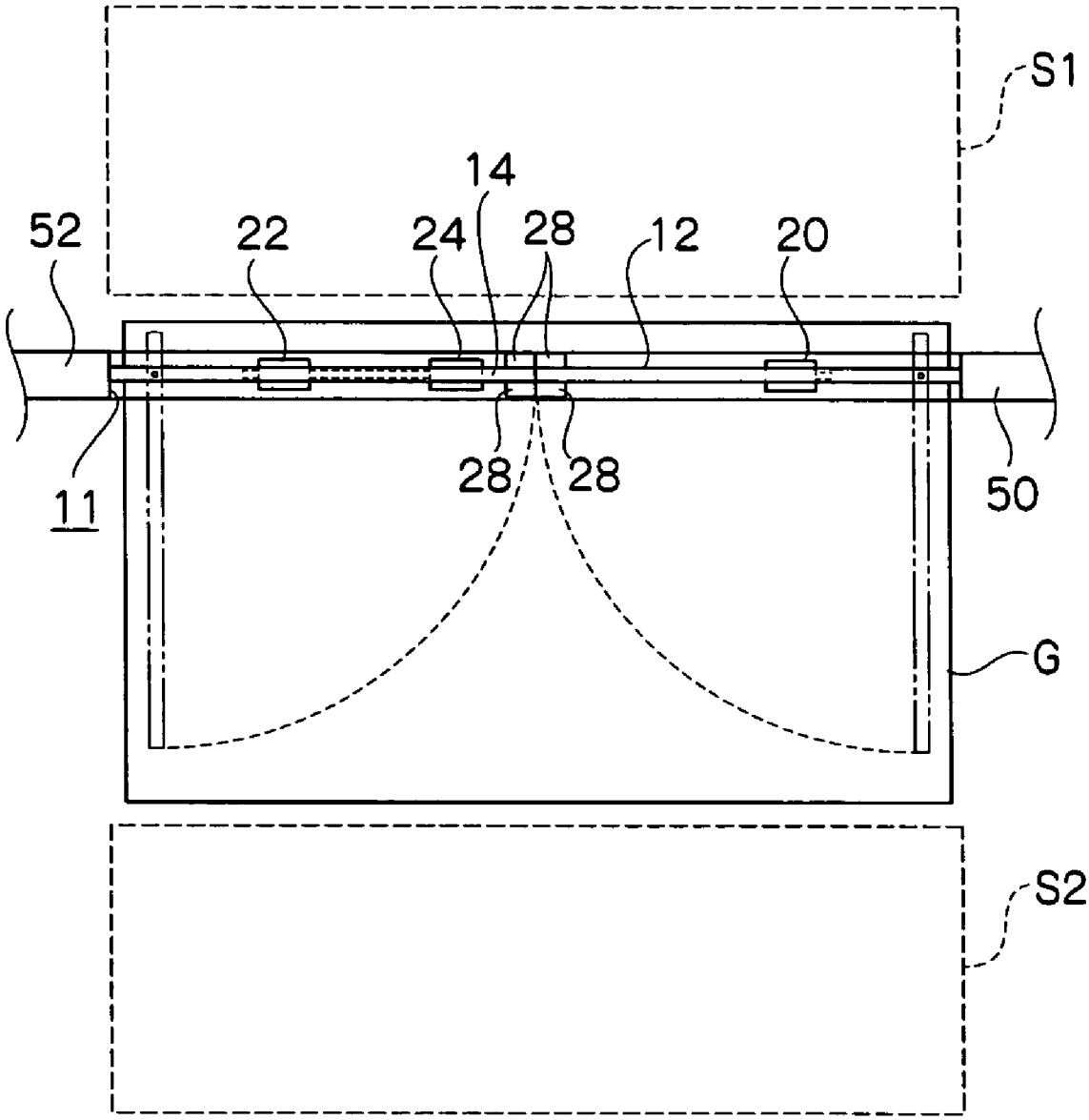
FIG. 3 is a plane view showing a closed position in which the door main bodies are closed relative to the opening part.

As shown in FIG. 1 to FIG. 3, a swing door opening/closing detection system 10 includes a swing door. The swing door is composed of a pair of door main bodies 12, 14. The door main bodies 12, 14 are formed in a rectangular shape, and on outer widthwise end portions of the door main bodies 12, 14, hinges 56 (hinge on one side is not shown) are attached to span onto fixed walls 50, 52 respectively. Thus, the door main bodies 12, 14 are rotatably attached to the fixed walls 50, 52 via the hinges 56. Further, motors (driving parts) 20, 22 for rotary driving the door main bodies 12, 14 are disposed near the opening part 11, and when the motors 20, 22 are driven, the door main bodies 12, 14 are rotary driven. A control part (control part) 24 for controlling the driving of the motors 20, 22 is further disposed near the motors 20, 22. According to an output signal from the control part 24, the motors 20, 22 are controlled to be driven/stopped.

Further, as shown in FIG. 1 to FIG. 3, object sensors (a sensing part, a discriminating part) 28 are attached to approach-side surfaces and swing-side surfaces of the door main bodies 12, 14 respectively. The object sensors 28 include sensor parts (sensing part) 30 sensing a person or an object existing in a sensing area G on paths of the door main bodies 12, 14. Each of the object sensors 28 further includes a storage part 38 storing a table showing the correspondence relation between a torsional deformation amount of a later-described wiring cover 42 and a rotation angle of the door main body 14. The object sensor 28 also includes a signal generating circuit part 32, which generates predetermined signals based on an output signal from the sensor part 30 and on the table stored in the storage part 38, respectively. The object sensor 28 further includes a signal transmitting part 34, which transmits the signals generated in the signal generating circuit part 32 to the control part 24. The control part 24, when receiving the signals, controls the rotary driving of the door main bodies 12, 14 based on these signals. For example, when a detection signal is outputted from the sensor parts 30 to the signal generating circuit part 32, the signal generating circuit part 34 generates a predetermined control signal, which is then transmitted from the signal transmitting part 34 to the control part 24, so that the rotary driving of the door main bodies 12, 14 is stopped. Further, the object sensor 28 includes an arithmetic part (a discriminating part) 40 which calculates the rotation angle of the door main bodies 12, 14 based on the table stored in the storage part 38. The arithmetic part 40 calculates the rotation angle of the door main bodies 12, 14 to discriminate an opening/closing position of the door main bodies 12, 14. Further, based on data from the arithmetic part 40, the signal generating circuit part 32 generates a predetermined signal, which is then transmitted to the control part 24 from the signal transmitting part 34, so that the rotary driving of the door main bodies 12, 14 are controlled.

Figure 4:
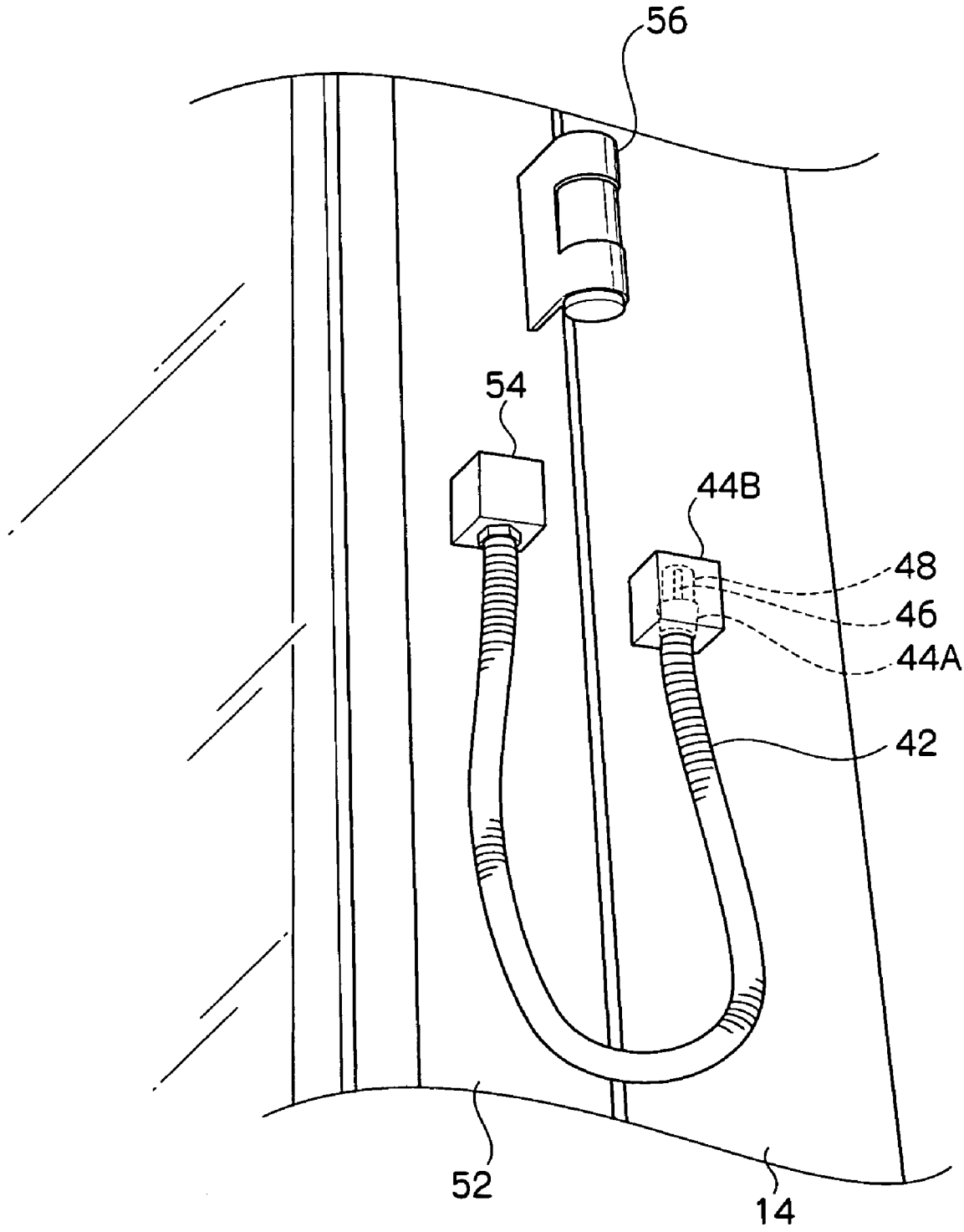
FIG. 4 is a perspective view showing how a deformation part used in the swing door opening/closing detection system according to this embodiment is attached to the door main body.

Further, as shown in FIG. 4, on the approach-side surface and the swing-side surface of each of the door main bodies 12, 14, wiring covers (deformation part) 42 for protecting electrical wirings 46 (electrical wirings on the door main body 12 side are not shown) electrically connected to the object sensors 28 are attached. The wiring cover 42 is in a cylindrical shape, and a rotary shaft 48 is attached to one end thereof. The rotary shaft 48 is attached to the door main body 14 to be rotatable about its axis. Further, the other end of the wiring cover 42 is fixed to the fixed wall 52, which rotatably supports the door main body 14, with a fixing member 52 so as not to rotate.

Further, an electrical wiring 46 electrically connected to the object sensor 28 passes inside the wiring cover 42 and the rotary shaft 48. The electrical wiring 46 is connected to an external power source (not shown) and the control part 24.

Near the wiring cover 42, a detecting part 44 detecting a torsional deformation amount of the wiring cover 42 is provided. The detecting part 44 is composed of a rotation-side detecting part 44A (for example, a magnet) which is attached to the rotary shaft 48 to rotate together with the rotary shaft, 48 and a fixed-side detecting part 44B (for example, a magnetic sensor) which rotatably supports the wiring cover 42 and detects the rotation angle of the rotation-side detecting part 44A. The fixed-side detecting part 44B detects the rotation angle of the rotation-side detecting part 44A (for example, the magnetic sensor detects a magnetisms change amount of the magnet), and outputs data on the rotation angle as a torsional deformation amount of the wiring cover 42 to the arithmetic part 40 of the object sensor 28.

As shown in FIG. 1, an activate sensor 36 (not shown in FIG. 2) is disposed near the opening part 11. The activate sensor 36 detects a person or an object in a detection area S1 on an approach side of the opening part 11 and in a detection area S2 on a swing-side of the opening part 11. The activate sensor 36, which has the same structure as a conventionally used activate sensor, outputs a predetermined signal to the control part 24 when the activate sensor 36 detects a person or an object such as baggage in either of the detection areas S1, S2. The control part 24, when the predetermined signal is outputted thereto, controls the motors 20, 22 to be driven based on the signal, so that the door main bodies 12, 14 are rotary-driven to open relative to the opening part 11.

Incidentally, in the above description, the object sensor 28 used in this embodiment includes the signal generating circuit part 32 generating the predetermined signals. However, this structure is not restrictive, but a possible alternative structure may be such that a signal transmitting device (not shown) including a signal generating circuit part generating the aforesaid signals is disposed separately from the object sensor, and this signal transmitting device transmits the predetermined signals to the object sensor. The signal transmitting part 34 may transmit the control signal to the control part 24 based on the signals transmitted to the object sensor.

Further, this embodiment has described the example where the object sensor 28 and the activate sensor 36 are separate bodies. However, this structure is not restrictive, but a sensor in which the both sensors are integrated may be used.

Further, this embodiment has described, as an example, the structure in which the sensor part 30 and the arithmetic part 40 are mounted in the object sensor 28. However, this structure is not restrictive, but the both may be separately provided as separate independent devices.

Next, operations of the swing door detection system 10 according to this embodiment will be described.

Figure 5:
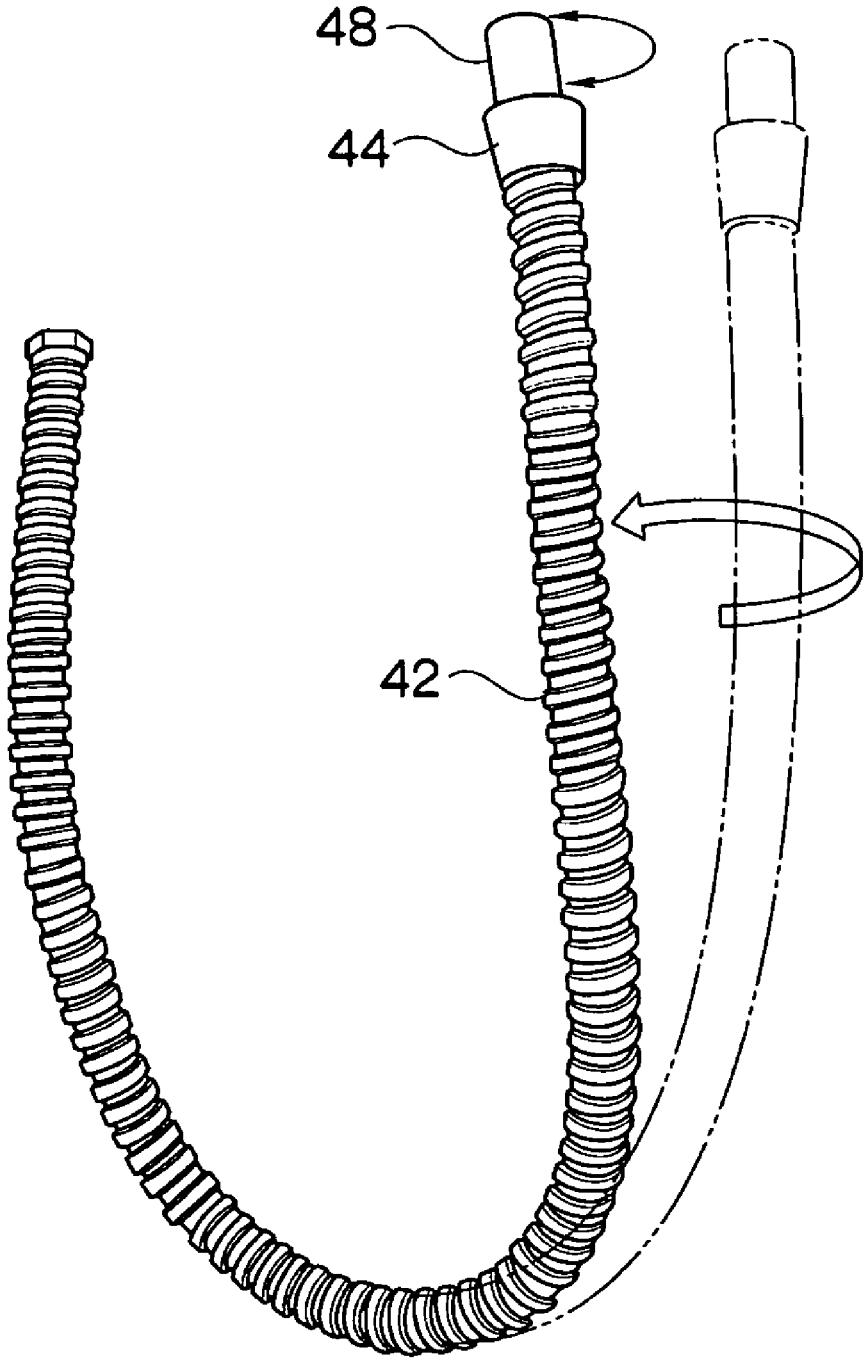
FIG. 5 is a perspective view showing how the deformation part used in the swing door opening/closing detection system according to this embodiment deforms.
Figure 6:
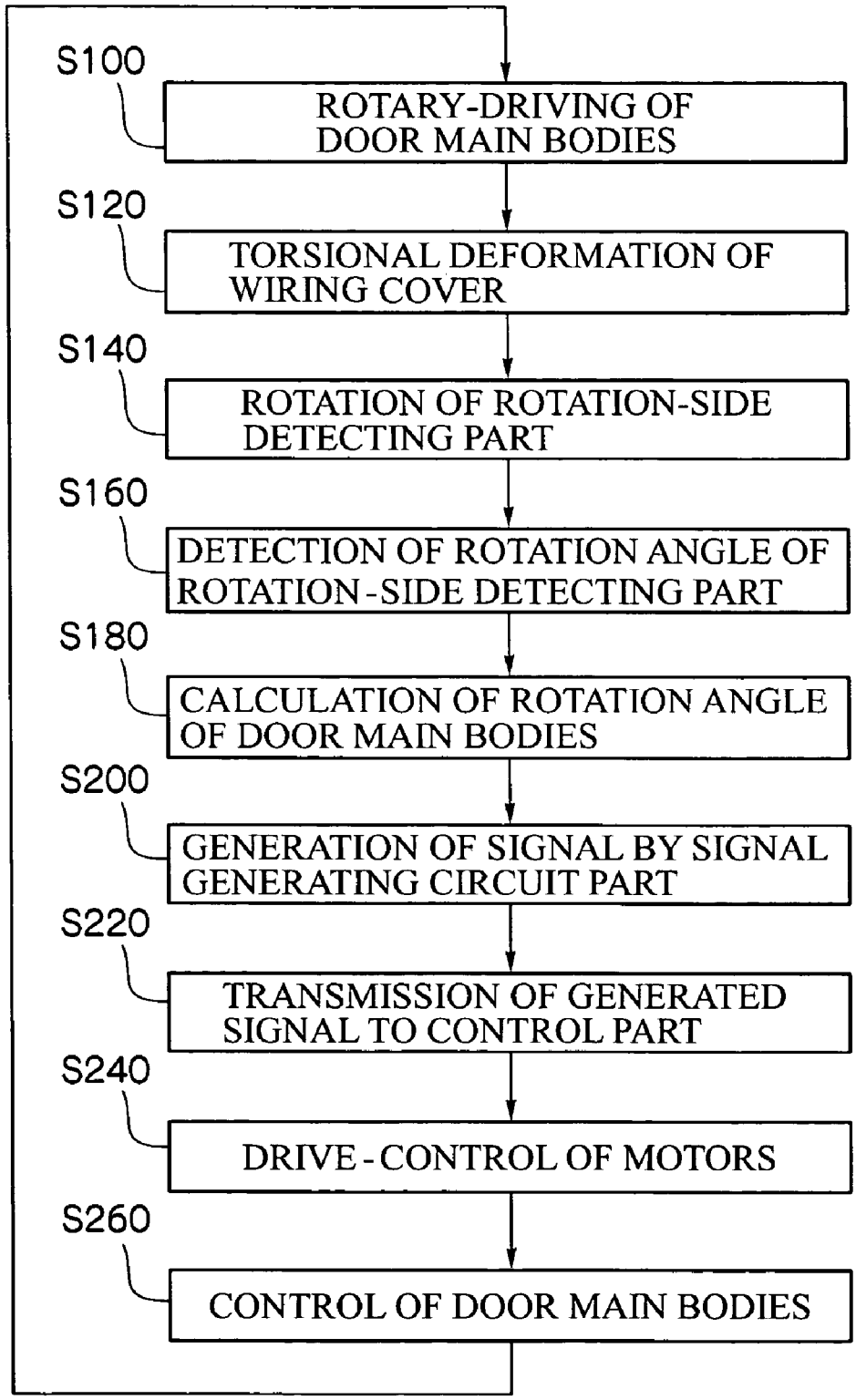
FIG. 6 is a flowchart showing operations of the swing door opening/closing detection system according to this embodiment.
Figure 7:
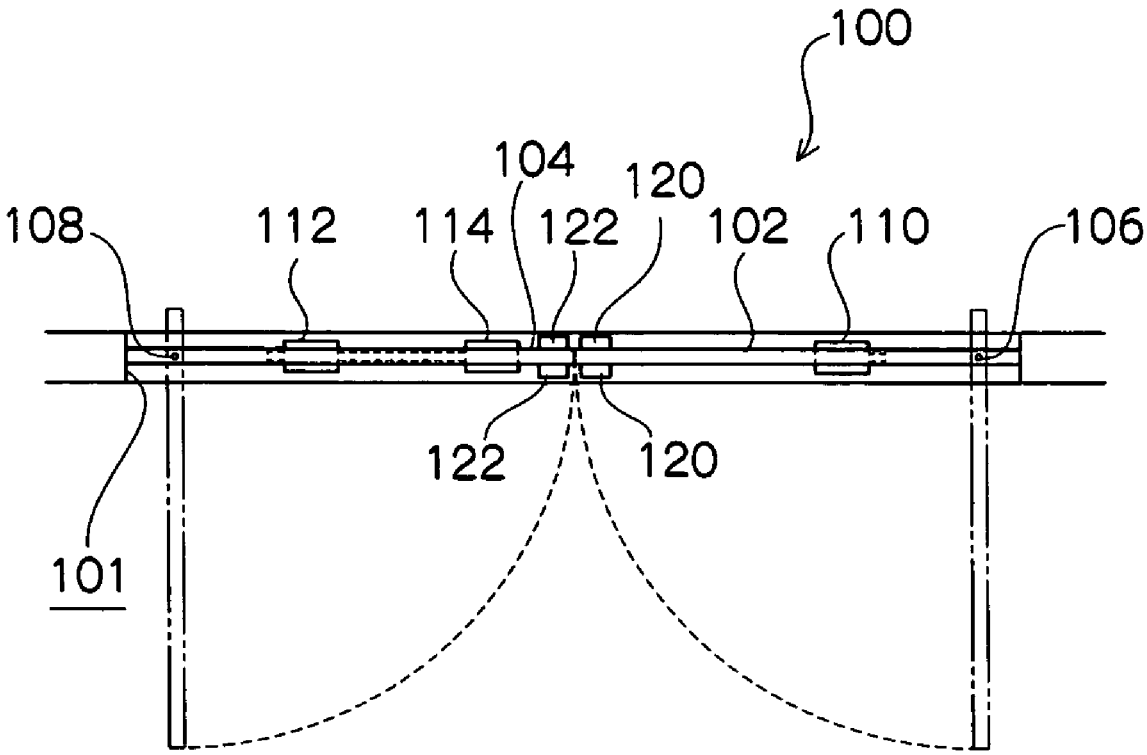
FIG. 7 is a block diagram showing a rough structure of a conventional double-leaf automatic swing door system, and is an operational view especially showing how door main bodies are closed or opened relative to an opening part.

As shown in FIG. 1, FIG. 2, FIG. 3, FIG. 5, and FIG. 6, when the door main bodies 12, 14 are controlled by the motors 20, 22 so that the opening part 11 is opened or closed, the door main bodies 12, 14 are rotary driven (Step S100). When the door main bodies 12, 14 are rotary driven, the wiring cover 42 torsionally deforms in accordance with the rotational operation of the door main bodies 12, 14 as shown in FIG. 4 and FIG. 5 (Step S120). When the wiring cover 42 torsionally deforms, the rotation-side detecting part 44A rotates in accordance with the torsional deformation of the wiring cover 42 (Step S140). When the rotation-side detecting part 44A rotates, the rotation angle of the rotation-side detecting part 44A is detected by the fixed-side detecting part 44B (Step S160). When the rotation angle of the rotation-side detecting part 44A is detected by the fixed-side detecting part 44B, the data on the rotation angle is outputted as the torsional deformation amount of the wiring cover 42 to the arithmetic part 40 of the object sensor 28. When the torsional deformation amount of the wiring cover 42 is outputted as data to the arithmetic part 40, the rotation angle of the door main bodies 12, 14 is calculated based on the table stored in the storage part 38 (Step S180). In this manner, the opening/closing position of the door main bodies 12, 14 can be accurately discriminated. Further, when the arithmetic part 40 calculates the rotation angle of the door main bodies 12, 14, the calculation result is outputted as data to the signal generating circuit part 32. When the calculation result of the arithmetic part 40 is outputted as data to the signal generating circuit part 32, the signal generating circuit part 32 generates the predetermined signal (Step S200), and the signal transmitting part 34 transmits the generated signal to the control part 24 (Step S220). When the signal is transmitted to the control part 24, the motors 20, 22 are controlled to be driven by the control part 24 based on the signal (Step S240), so that the door main bodies 12, 14 are controlled to be rotary-driven (Step S260).

Note that, after the processing at Step S260 is finished, the flow returns to Step S100 again, where, similarly to the above, the rotation angle of the door main bodies 12, 14 is calculated based on the torsional deformation amount of the wiring cover 42, and the door main bodies 12, 14 are controlled to be rotary-driven based on the calculation result.

Incidentally, if both of the door main bodies 12, 14 are simultaneously controlled by the control part 24 to be rotary driven, the wiring cover 42 needs to be attached only to one of the door main bodies 12, 14, for example, to the door main body 14, and with this structure, it is possible to calculate the rotation angle of both of the door main bodies 12, 14.

As described above, according to the swing door opening/closing detection system 10 of this embodiment, the rotation angle of the door main bodies 12, 14 is calculated based on the torsional deformation amount of the wiring cover 42, so that the opening/closing position of the door main bodies 12, 14 can be accurately discriminated (recognized). As a result, the control part 24 can accurately control the motors 20, 22 and the door main bodies 12, 14 based on the discrimination result. Therefore, the malfunction of the door main bodies 12, 14 can be prevented.

In particular, the deformation part is constituted of the wiring cover 42 protecting the electrical wiring 46 connected to the object sensor 28, so that the wiring cover 42 indispensable to the electrical wiring 46 can be utilized for discriminating the opening/closing position of the door main bodies 12, 14. This can reduce not only the number of parts but also manufacturing cost, compared with a case where a separate member is used to discriminate the opening/closing position of the door main bodies 12, 14.

Further, since the object sensor 28 also functions as the arithmetic part 40 calculating the torsional deformation amount of the wiring cover 42, it is possible to reduce the number of parts of the swing door opening/closing detection system 10 and reduce the trouble accompanying its installation. Moreover, only smaller installation space is required compared with a case where a separate member is used as the arithmetic part 40 and the both are provided in a space near the swing door, so that space saving can be realized.

Incidentally, this embodiment has described as an example the structure in which the opening/closing position is discriminated by calculating the rotation angle of the door main bodies 12, 14 based on the torsional deformation amount of the wiring cover 42. However, this structure is not restrictive, but a possible alternative method is, for example, detecting a bending deformation amount of the electrical wiring 46, a metal member (not shown, a bending deformation member) provided inside the electrical wiring 46, or an optical fiber (not shown, a bending deformation member) based on an incident angle of light passing through a distortion gauge or an optical fiber to calculate the rotation angle of the door main bodies 12, 14 based on the detection result.

Another possible method is detecting by a distortion gauge or the like the bending deformation amount of the wiring cover 42 when it bendingly deforms in accordance with the rotational operation of the rotary-driven door main body 14, to calculate the rotation angle of the door main bodies 12, 14 based on the detection result.

Further, the above embodiment has described the structure in which the rotation angle of the door main bodies 12, 14 is calculated and the control part 24 controls the door main bodies 12, 14 based on the rotation angle. However, the basis of the control is not limited to the rotation angle of the door main bodies 12, 14. For example, information on a detected rotation speed, rotation direction, or the like of the door main bodies 12, 14 may be used as a basis of discriminating the opening/closing position of the door main bodies 12, 14.

According to the present invention, it is possible to accurately discriminate the opening/closing position of the door main bodies, and the rotary driving of the door main bodies is controlled based on the discrimination result, so that the malfunction of the door main bodies can be prevented.

What is claimed is:

1. A swing door opening/closing detection system comprising:

a door main body which is rotatably provided and which rotates to open/close relative to an opening part;

a driving part rotary driving said door main body;

a control part controlling the rotary driving of said door main body by said driving part;

a sensing part attached to said door main body to sense a person or an object in a sensing area on a path of said door main body;

a deformation part having a first end attached to the door main body and a second end attached to a fixed body that remains fixed regardless of a rotational position of said door main body, said deformation part being configured to exhibit an amount of tortional deformation corresponding to the rotational position of said door main body; and a discriminating part configured to determine an opening/closing position of said door main body based on the amount of tortional deformation of said deformation part so as to control an operation of said control part based on a determination result of the discriminating part.

2. The swing door opening/closing detection system according to claim 1, further comprising an object sensor, wherein said sensing part and said discriminating part are included in said object sensor.

3. The swing door opening/closing detection system according to claim 1, wherein said deformation part is a wiring cover protecting an electrical wiring connected to said sensing part, said wiring cover having the first end and the second end.

4. The swing door opening/closing detection system according to claim 3, further comprising an object sensor, wherein said sensing part and said discriminating part are included in said object sensor.

5. The swing door opening/closing detection system according to claim 3, wherein the first end of the wiring cover is attached to said door main body which is rotatable about an axis and the second end of the wiring cover is fixed to a fixed wall, and wherein said discriminating part determines the opening/closing position of said door main body based on an amount of torsional deformation of the wiring cover that torsionally deforms in accordance with the rotational operation of said door main body.

6. The swing door opening/closing detection system according to claim 5, further comprising an object sensor, wherein said sensing part and said discriminating part are included in said object sensor.

7. The swing door opening/closing detection system according to claim 1, wherein said deformation part is one of an electrical wiring connected to said sensing part and a bending deformation member included in the electrical wiring, and wherein said discriminating part determines the opening/closing position of said door main body based on a bending deformation amount of one of the electrical wiring and the bending deformation member that bendingly deforms in correspondence with an amount of rotation of said door main body.

8. The swing door opening/closing detection system according to claim 7, further comprising an object sensor, wherein said sensing part and said discriminating part are included in said object sensor.

* * * * *